United States Patent [19]

Götz et al.

[11] Patent Number: 4,833,995

[45] Date of Patent: May 30, 1989

[54] FIN-STABILIZED PROJECTILE

[75] Inventors: Udo Götz, Trossingen; Dietrich Hoffmann; Anita Fleig, both of Schramberg; Adolf Armbruster, Aichhalden, all of Fed. Rep. of Germany

[73] Assignee: Mauser-Werke Oberndorf GmbH, Obernodorf, Fed. Rep. of Germany

[21] Appl. No.: 887,527

[22] Filed: Jul. 14, 1986

[30] Foreign Application Priority Data

Jul. 19, 1985 [DE] Fed. Rep. of Germany ..... 3525854

[51] Int. Cl.[4] ..... F42B 13/16; F42B 31/00

[52] U.S. Cl. ..... 102/521; 102/524; 102/527

[58] Field of Search ..... 102/520–528, 102/501; 244/3.23–3.3

[56] References Cited

U.S. PATENT DOCUMENTS

| | | | |
|---|---|---|---|
| 3,228,335 | 1/1966 | Thompson | 244/3.24 |
| 3,378,216 | 4/1968 | Oss et al. | 244/33 |
| 3,496,869 | 2/1970 | Engel | 102/522 |
| 4,015,534 | 4/1977 | Engel et al. | 102/513 |
| 4,109,582 | 8/1978 | Haep et al. | 102/526 |
| 4,444,113 | 4/1984 | Campoli | 102/521 |
| 4,532,868 | 8/1985 | Gleichaut et al. | 102/527 |

FOREIGN PATENT DOCUMENTS

| | | | |
|---|---|---|---|
| 2071825 | 9/1981 | United Kingdom | 244/3.24 |

*Primary Examiner*—Harold J. Tudor

*Attorney, Agent, or Firm*—Scully, Scott, Murphy & Presser

[57] ABSTRACT

A fin-stabilized projectile for weapons selectively possessing either a smooth, and in particular, a rifled weapon barrel, which possesses a discardable thrust ring constituted of segments arranged on the central form-fitted component, and of a through-sliding guide band, and which is provided at the tail end of the projectile with a multi-finned stabilizing guidance mechanism which is rotatable about the longitudinal axis of the projectile.

16 Claims, 1 Drawing Sheet

FIN-STABILIZED PROJECTILE

BACKGROUND OF THE INVENTION

1. Field of the Invention

The present invention relates to a fin-stabilized projectile for weapons selectively possessing either a smooth, and in particular, a rifled weapon barrel, which possesses a discardable thrust ring constituted of segments arranged on the central form-fitted component, and of a through-sliding guide band, and which is provided at the tail end of the projectile with a multi-finned stabilizing guidance mechanism which is rotatable about the longitudinal axis of the projectile.

2. Discussion of the Prior Art

From the disclosure of German Laid-open Patent Appln. No. 29 24 217 there has become known a subcaliber fin-stabilized inertial projectile for weapons possessing rifled barrels. The stabilizing guidance mechanism of this projectile is arranged at the end thereof so as to be rotatable about the longitudinal axis of the projectile. In an intermediate form-fitted region, the projectile body is encompassed by a segmented propulsion mechanism with a through-sliding guide band. However, this fin-stabilized projectile is completely unprotected along its entire outer region, and thereby not sheltered against any damage, for example, which is encountered during the delivery of the projectile into the weapon. Furthermore, it cannot be ascertained in this projectile in which manner there can be inserted a propellant casing, and as to how the propellant gases will, subsequent to detonation, effectively act on the projectile.

From the disclosure of European Pat. No. 49 738 there has become known a fin-stabilized inertial projectile with a high ratio of length to diameter, in which the guidance mechanism is fastened in the grooves of a carrier. Hereby, the fastening of the guidance mechanism to the carrier is implemented through soldering or adhesives.

Finally, from the disclosure of German Pat. No. 27 47 313 there has become known a subcaliber projectile with a drag-stabilized conical trailing end, in which the projectile is imparted with an extremely great length in comparison with its diameter. A propulsion mechanism is arranged in the central region of the projectile which, by means of a gearing, transmits the accelerating forces of the powder gases to the projectile. This propulsion mechanism is constructed in separate parts and, in this projectile, detaches itself from the projectile body immediately after leaving the weapon barrel.

SUMMARY OF THE INVENTION

Accordingly, commencing from the above-mentioned state-of-the-technology, it is an object of the present invention to provide a fin-stabilized projectile of the above-mentioned type, which can be fired particularly from a rifled barrel, and selectively also from a smooth gun bore or weapon barrel; which additionally possesses a guidance mechanism with a large aerodynamic cross-section and high strength, and which in a simple manner eliminates any damaging action imparted by a residual spin to the stabilizing guidance mechanism, and facilitates a simple manufacture in the production of an overall optimally designed fin-stabilized projectile.

The foregoing object is inventively attained in that the projectile is imparted at least a residual spin subsequent to leaving the weapon barrel, and possesses a thrust ring constituted of a material of higher specific weight than the hood or cowling arranged ahead of the thrust ring, in which the thrust ring, prior to or almost concurrently with the hood, will open radially after leaving the weapon barrel due to the centrifugal force which is imparted to the projectile.

In a particular configuration, the stabilizing guidance mechanism can be formed from sheet metal and fastened in longitudinal grooves of a carrier which is rotatably fastened on the tail end portion of the projectile. Furthermore, a plastic sealing plate with an annular connector can be arranged on the circular rear side of the thrust ring, which annular connector or web engages form-fittingly into a facing annular groove in the thrust ring, while, moreover, in the leading region of the thrust ring there can be arranged an encompassing ring of an elastic material; the through-sliding guide band can be in parts and inserted in a retainer slide ring of the thrust ring; and, finally, there can be provided a forward plastic hood or cowling which possesses elongate rupture locations, and which has its rearward end surface extending into close proximity with the retainer slide ring.

In one embodiment of the invention, the stabilizing guidance mechanism can be constituted of thin spring steel. Hereby, the stabilizing guidance mechanism can be fixedly connected with the carrier by laser welding through the insertion of a thin welding wire into the longitudinal grooves.

Pursuant to a further embodiment of the invention, there can be provided at the projectile tail end, coaxially with the stabilizing guidance mechanism, a cup for a tracer composition, whose outer diameter is less than the inner diameter of the carrier for the stabilizing guidance mechanism, which is at its rear end, retained in position within a groove through the intermediary of a fastener ring.

Furthermore, the thrust ring can be constituted of a total of four segments, which are each formed of aluminum. The ring holding together the four segments of the thrust ring can e constituted of rubber.

For the purpose of achieving a simple manufacture, the guide band can be consisted of two half-rings, which are fixedly interconnectable with each other by means of a simple snap closure. The retainer slide ring, in the inventive embodiment, can possess a smooth surface for the receipt of the guide band. Finally, the projectile hood or cowling, the retainer slide ring, and the sealing plate can all consist of the same plastic material, and be sprayed in a single, common workstep onto the projectile or its components.

Through the stabilizing guidance mechanism which is constituted of thin spring steel, which is fastened onto the carrier by means of laser beam welding and through the insertion of a thin welding wire, with an end surface of aerodynamically small cross-section and a relatively large fin surface, there is obtained a high degree of strength.

Hereby, the special welding produces a doubling in the durability between the stabilizing guidance mechanism and the rotatable carrier.

The cup with the tracer composition arranged at the tail end is, in principle, a part of the projectile body. However, in accordance with further inventive features, it can also be attached to the projectile body through either a screw-threaded or formed-fitted connection. The stabilizing guidance mechanism, during assembly, is simply slid over this cup of tracer composition, and retained at its trailing end through the intermediary of a pressed-on fastening ring.

The four-segment thrust ring of aluminum assumes the through-sliding guide band; in essence serves for the taking along of the projectile during passage through the weapon or gun barrel, and possesses recessed ridges for the propellant casing. Serving for the adjustment of the segments prior to the spraying on of the plastic hood or cowling is a front rubber ring.

The plastic guide band consists of two half-rings which are equipped with a snap closure. The guide band tolerances are designed in such a manner that after the latching together of the half-rings, there is produced a complete guide band with a definite play in the guide band recess.

Through the retainer slide ring there is afforded the capability of creating a smooth bearing surface for the through-sliding guide band, which is necessary for a rifled barrel. Moreover, there is also achieved a compensation between the tolerances of the individual segments of the thrust ring. Herein, inasmuch as the thrust ring segments are held together by the retainer slide ring, there is simultaneously also effectuated an unstressing of the guide band during passage through the weapon barrel.

A simplification in the manufacturing procedure is achieved in that the components, projectile hood, retainer slide ring and sealing disc are all constituted of a unitary plastic material and are sprayed in a common single workstep onto the projectile or the projectile components.

The hood, which is provided with elongate rupture locations is so designed as to protect the finned projectile, affords introduction thereof into the weapon, guides the finned projectile in the barrel, and releases the fin-stabilized projectile from the muzzle of the barrel without any difficulties.

The significant advantages of the invention consist of in that a residual spin is inherent in the projectile body upon leaving the weapon, which in an expedient instance lies below the spin caused by the barrel. As a result of this residual spin, which is facilitated because of the through-sliding guide band, the projectile body possesses centrifugal forces which cause a release of the hood and the thrust ring upon leaving of the weapon barrel. It is of consequence herein that the thrust ring possesses a higher specific weight than the front hood, as a result of which there is afforded that the thrust ring will open radially before the hood or at least simultaneously with the hood, and will detach from the projectile body. This results in a separation without any disruptive influence on the projectile body or on the guidance mechanism at the trailing end thereof, and thereby without any disturbance to the trajectory and the aerodynamic behavior of the projectile body.

The inventive projectile leads to a minimizing of the internal-ballistic ballest weight, and to a utilization of the open space between the fins. In addition, there is outer-ballistically achieved a high speed against the target in a high degree of hit accuracy through the maximizing of the cross-sectional loading at a concurrent reduction in the cw-value, because of the extremely thin, laser beam-welded spring steel employed for the guidance fins. Furthermore, there is, with assurance, obtained a reproducible thrust ring detachment through the utilization of a defined residual rotational speed under spin compensation by means of the through-sliding guide band which is constituted of a plastic material.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
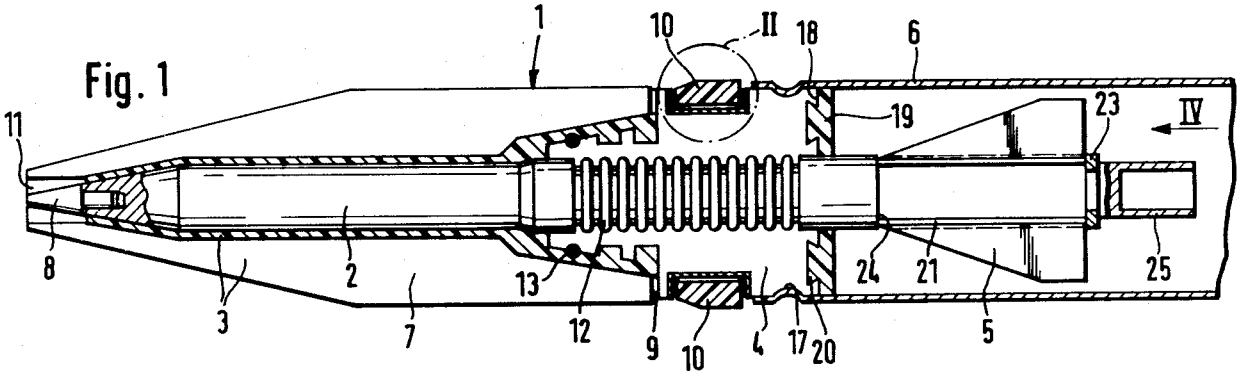
FIG. 1 illustrates a longitudinal sectional view of the inventive fin-stabilized projectile.
Figure 4:
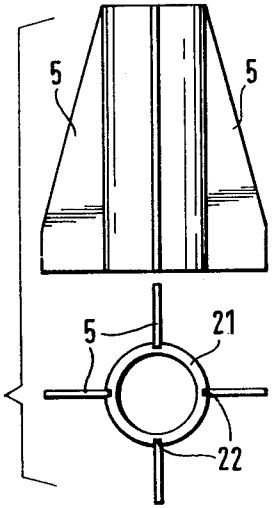
FIG. 4 illustrates, respectively, a side view and plan view of the stabilizing guidance mechanism.

The fin-stabilized projectile 1 essentially consists of the actual projectile body 2, the front plastic hood or cowling 3, the central thrust ring 4 and the stabilizing guidance mechanism 5. Connected thereto, at the trailing end, is the propellant casing 6.

The hood 3, which is constituted from a plastic material, is constructed as one piece, and possesses longitudinal rupture or breaking locations 7 which, in the representation shown in FIG. 1, extend within the plane of the drawing section and at 90° relative thereto. The plastic hood 3 extends conically proceeding from the projectile tip 8 over a portion of its length and then extends into a transition as a cylindrical portion. Instead of this conical configuration, it is naturally also possible that the hood 3 can be elliptically-shaped or concave, or in any manner configured rounded and free of sharp edges. It is important that the hood 3 reduces forwardly towards the tip, and is formed without any disruptive edges.

The rear end surface 9 of the hood 3 extends into close proximity to the guide band 10 of the projectile. Furthermore, the hood 3 possesses an inflow recess 11 at the projectile tip 8.

The hood is, in general, so designed as to protect the projectile body with the stabilizing guidance mechanism 5, which affords an introduction into the weapon without problems, which satisfactorily guides the projectile body within the weapon barrel, and finally discharges the projectile body at the muzzle of the weapon barrel without interference.

Figure 3:
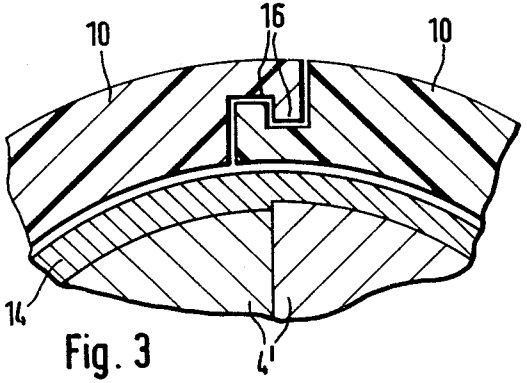
FIG. 3 illustrates a sectional view of a segment of the thrust ring taken along line III—III in FIG. 2.
Figure 2:
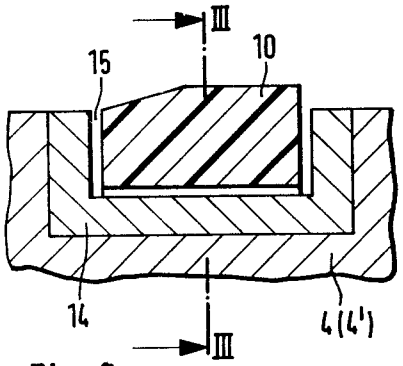
FIG. 2 illustrates, on an enlarged scale, a detail of the encircled portion 2 in FIG. 1, with the representation of the guide band.

The essentially cylindrical projectile body 2 possesses, in approximately its middle region, a form-fitted part 12 which, in the illustrated embodiment of FIG. 1, consists of adjoiningly located annular grooves. Instead of such annular grooves there can also be provided other form-fitting members, such as, for example, screw threads. With this form-fitted member 12 of the projectile body 2 there is connected the thrust ring 4 in a close fit. Hereby, the thrust ring 4, in general, consists of four segments 4' which are all identically configured and which are positioned to form a single member extending about the form-fitted part 12. A rubber ring 13 which is inserted in the front region of the thrust ring 4, serves for the adjustment of the individual thrust ring segments 4' prior to the spraying on of the plastic hood 3. Inserted into an externally extending annular groove of the thrust ring 4 is a retainer slide ring 14. Located in the retainer slide ring 14 is a plastic guide band 10. This guide band 10 is constituted of two half-rings and is inserted with a lateral spacing 15 as well as with regard to the bottom, in the retainer slide ring 14 as a through-sliding guide band. The snap closure, in the simple construction pursuant to FIG. 3, can be formed by an interengageable connector-groove attachment 16.

The thrust ring segments possess, facing towards the rearward end, a circumferentially extending recessed ridge 17 which serves for the fastening of the propellant casing 6 with the thrust ring 4.

The entire four-segment thrust ring 4 is constituted of aluminum although if desired, the material thereof may also be plastic, metal inserts or fiber-reinforced plastic, and receives the through-sliding guide band 10, thereby serving for the taking along of the projectile body 2 during passage through the barrel, and contains the recessed ridge 17 for the propellant casing 6.

Attached to the rearward end surface of the thrust ring 4, or the thrust ring segments 4', is a sealing disc 19 which is constituted of plastic material. The plastic sealing disc 19 possesses an annular web 20 which engages into a complimentary annular groove in the thrust ring segments 4. The plastic sealing disc is commonly sprayed, and in a single workstep, together with the plastic hood 3 and the retainer slide ring 14 onto the projectile.

Rotatably supported on the trailing end of the projectile body 2 is a casing or sleeve 21. This sleeve 21 possesses four longitudinal grooves 22 which are offset by 90° relative to each other, and into which there is inserted the stabilizing guidance mechanism 5. The fastening of this stabilizing guidance mechanism, which is constituted of spring steel, is effected in a manner whereby thin welding wires are inserted into the longitudinal grooves, and there is then carried out a laser beam welding of the stabilizing guidance mechanism to the sleeve. The selected spring steel possesses a hardness of $<50$ HRC. In order to obtain the necessary stability and strength, the stabilizing guidance mechanism 5 is inventively annealed at about 550° C., and thereafter cooled down in an annealing furnace. Subsequently, there is effected the hardening of this stabilizing guidance mechanism 5 at about 650° to 700° C. The sleeve 21 together with the stabilizing guidance mechanism 5 is secured against any rearward sliding out through the intermediary of a fastener ring 23. Towards the front, the sleeve contacts against a shoulder 24 on the projectile body 2.

Connected to the stabilizing guidance mechanism 5, arranged on the projectile body and formed integrally therewith is a tracer composition cup 25, whose outer diameter is smaller than the inner diameter of the sleeve 21. Consequently, it is possible that the stabilizing guidance mechanism 5 together with the carrier formed by the sleeve 21, can be slid over tracer composition cup 25 during assembly.

What is claimed is:

1. In a fin-stabilized projectile for weapons with, selectively, smooth-bore or rifled weapon barrels, including a discardable thrust ring constituted of a plurality of segments arranged on a central projectile body component having said thrust ring form-fittingly connected therewith; a partitioned through-sliding guide band, a retainer slide ring having said guide bank inserted therein; said guide band imparting an at least residual spin to said projectile upon exiting from said weapon barrel; and a multi-finned stabilizing guidance mechanism which is rotatable about the longitudinal axis of the projectile being located at the trailing end of the projectile; the improvement comprising: said thrust ring being constituted of a material of higher specific weight than a plastic hood arranged on said projectile body in front of the thrust ring body, said thrust ring opening before or almost simultaneously with the hood upon exiting the weapon barrel responsive to centrifugal force imparted to the projectile; a plastic sealing disc having an annular web, said disc being arranged on a circular rear surface on said thrust ring, said annular web form-fittingly engaging into a facing groove in said rear surface on the thrust ring; a circumferential ring constituted of an elastic material being applied in the front region of the thrust ring; said stabilizing guidance mechanism being constituted of a thin spring steel and fastened in longitudinal grooves on a carrier which is rotatably mounted on the trailing end of the projectile; and said plastic hood possessing longitudinally extending rupture locations and having a rearward end surface extending into proximity with said retainer slide ring.

2. A fin-stabilized projectile as claimed in claim 1, wherein the segments of the thrust ring are constituted of a fiber-reinforced plastic material.

3. A fin-stabilized projectile as claimed in claim 1, wherein the stabilizing guidance mechanism is welded to the carrier through thin welding wire into which is arranged in each of the longitudinal grooves.

4. A fin-stabilized projectile as claimed in claim 1, wherein the stabilizing guidance mechanism is constituted of spring steel having a hardness of $<50$ HRC.

5. A fin-stabilized projectile as claimed in claim 4, wherein the spring steel is a steel annealed at about 550° C., cooled in an annealing furnace and hardened at about 650° to 700° C.

6. A fin-stabilized projectile as claimed in claim 1, wherein a tracer composition cup is located on the projectile trailing end coaxial with the stabilizing guidance mechanism, said cop having an outer diameter which is smaller than the inner diameter of the carrier for the stabilizing guidance mechanism which is retained in position at its rear side through a fastener ring located in an annular groove.

7. A fin-stabilized projectile as claimed in claim 6 wherein the tracer composition cup is form fittingly and load-transmissively connected with the trailing end of the projectile.

8. A fin-stabilized projectile as claimed in claim 1, wherein the thrust ring is assembled from a total of four segments which are constituted of metal.

9. A fin-stabilized projectile as claimed in claim 8, wherein the segments of the thrust ring are constituted of aluminum.

10. A fin-stabilized projectile as claimed in claim 1, wherein the segments of the thrust ring are constituted of plastic.

11. A fin-stabilized projectile as claimed in claim 1, wherein the segments of the thrust ring are constituted of metal inserts.

12. A fin-stabilized projectile as claimed in claim 1, wherein the elastic material ring is constituted of rubber.

13. A fin-stabilized projectile as claimed in claim 1, wherein the guide band is constituted of two half-rings which are fixedly interengageable by a snap closure.

14. A fin-stabilized projectile as claimed in claim 1, wherein the retainer slide ring possesses a smooth surface for receiving the guide band.

15. A fin-stabilized projectile as claim in claim 1, wherein the projectile hood, the retainer slide ring and the sealing disc are constituted of the same plastic material.

16. A fin-stabilized projectile as claimed in claim 1, wherein the hood tapers forwardly towards a tip.

* * * * *

UNITED STATES PATENT AND TRADEMARK OFFICE

CERTIFICATE OF CORRECTION

PATENT NO. : 4,833,995

DATED : May 30, 1989

INVENTOR(S) : Udo Gotz, et al.

It is certified that error appears in the above-identified patent and that said Letters Patent is hereby corrected as shown below:

Column 2, line 43: "e" should read as --be--

Column 5, line 60: "bank" should read as --band--

Column 6, line 33, Claim 6: "cop" should read as --cup--

Signed and Sealed this

Thirty-first Day of July, 1990

*Attest:*

*Attesting Officer*

HARRY F. MANBECK, JR.

*Commissioner of Patents and Trademarks*